US011333418B2

(12) United States Patent
Jeong et al.

(10) Patent No.: US 11,333,418 B2
(45) Date of Patent: May 17, 2022

(54) REFRIGERATOR

(71) Applicant: SAMSUNG ELECTRONICS CO., LTD., Suwon-si (KR)

(72) Inventors: Jin Jeong, Yongin-si (KR); Kyoung Ki Park, Suwon-si (KR); Kook Jeong Seo, Seoul (KR); Bong Su Son, Cheonan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/652,201

(22) PCT Filed: Sep. 27, 2018

(86) PCT No.: PCT/KR2018/011422
§ 371 (c)(1),
(2) Date: Mar. 30, 2020

(87) PCT Pub. No.: WO2019/066489
PCT Pub. Date: Apr. 4, 2019

(65) Prior Publication Data

US 2020/0248947 A1 Aug. 6, 2020

(30) Foreign Application Priority Data

Sep. 29, 2017 (KR) ..... 10-2017-0128067

(51) Int. Cl.
*F25C 5/20* (2018.01)
*F25C 5/182* (2018.01)

(52) U.S. Cl.
CPC ..... *F25C 5/24* (2018.01); *F25C 5/182* (2013.01)

(58) Field of Classification Search
CPC ..... F25C 5/046; F25C 5/182; F25C 5/24
See application file for complete search history.

(56) References Cited

U.S. PATENT DOCUMENTS 4,972,999 A 11/1990 Grace
5,056,688 A * 10/1991 Goetz ..... F25C 5/22 222/146.6
6,010,037 A 1/2000 Thompson
(Continued)

FOREIGN PATENT DOCUMENTS

JP 2000-111222 4/2000
JP 2003-106717 4/2003
(Continued)

OTHER PUBLICATIONS

International Search report dated Jan. 28, 2019, in corresponding International Patent Application No. PCT/KR2018/011422.
(Continued)

*Primary Examiner* — Elizabeth J Martin
(74) *Attorney, Agent, or Firm* — Staas & Halsey LLP

(57) ABSTRACT

The present disclosure relates to a refrigerator including an ice bucket configured to store ice, a transfer member configured to transfer ice stored in the ice bucket, and an ice crushing device provided at an outer side of the ice bucket and configured to discharge cubed ice discharged from the ice bucket without crushing, or to crush and discharge the cubed ice.

14 Claims, 11 Drawing Sheets

(56) References Cited

U.S. PATENT DOCUMENTS

| | | | | |
|---|---|---|---|---|
| 7,571,619 | B2 * | 8/2009 | Park | F25C 5/12 62/320 |
| 2004/0261442 | A1 * | 12/2004 | Chung | F25C 5/046 62/344 |
| 2008/0134710 | A1 * | 6/2008 | An | F25C 5/185 62/344 |
| 2010/0025434 | A1 | 2/2010 | Buchstab et al. | |
| 2013/0105611 | A1 * | 5/2013 | Nuss | F25C 5/22 241/277 |

FOREIGN PATENT DOCUMENTS

| | | |
|---|---|---|
| JP | 2009-287856 | 12/2009 |
| KR | 10-2005-0041757 | 5/2005 |
| KR | 10-2006-0115306 | 11/2006 |
| KR | 10-2008-0052503 | 6/2008 |
| KR | 10-2013-0081136 | 7/2013 |
| KR | 10-2015-0058756 | 5/2015 |
| WO | WO 2008/028806 A2 | 3/2008 |

OTHER PUBLICATIONS

Extended European Search Report dated Aug. 28, 2020, in corresponding European Patent Application No. 18863104.8.

Notification of the First Office Action from Chinese Application No. 201880066632.4, dated Jul. 5, 2021 (13 pages including translation).

Korean Office Action dated Dec. 15, 2021 in Korean Application No. 10-2017-0128067 (7 pages, 6 pages English translation).

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2018/011422 filed on Sep. 27, 2018, which claims foreign priority benefit under 35 U.S.C. § 119 of Korean Patent Application No. 10-2017-0128067 filed on Sep. 29, 2017 in the Korean Intellectual Property Office, the contents of both of which are incorporated herein by reference.

TECHNICAL FIELD

The present disclosure relates to an ice discharge structure of an ice maker of a refrigerator.

BACKGROUND ART

Generally, a refrigerator is an appliance which includes a main body provided with a storage compartment therein and a cold air supply system supplying cold air to the storage compartment, thereby storing food in a fresh state. The storage compartment includes a refrigerating chamber for storing food in a refrigerating mode by maintaining indoor air at a temperature of about 0° C. to 5° C., and a freezing chamber for storing food in a freezing mode by maintaining indoor air at a temperature of about 0° C. to −30° C.

The refrigerator may include an ice maker to provide ice for convenience of use. The refrigerator may include an automatic ice maker to automatically generate ice, store the generated ice, and discharge the stored ice.

The automatic ice maker includes an ice making tray to produce ice, an ice bucket to store ice generated in the ice making tray, a transfer member provided inside the ice bucket to transfer the ice in the ice bucket, an ice crushing device to discharge the ice conveyed before discharge to cubed ice or to crushed ice according to a discharge mode, and a motor to drive the transfer member and the ice crushing device.

DISCLOSURE

Technical Problem

The present disclosure is directed to providing a refrigerator including an ice maker capable of preventing cubed ice or crushed ice from being discharged in a mixed state of the cubed ice and the crushed ice when the cubed ice or the crushed ice is discharged.

Further, the present disclosure is directed to providing a refrigerator in which an ice crushing device is disposed outside an ice bucket such that ice is not stuck on an ice crushing blade of the ice crushing device.

Technical Solution

One aspect of the present disclosure provides a refrigerator including an ice bucket configured to store ice, a transfer member configured to transfer ice stored in the ice bucket, and an ice crushing device provided at an outer side of the ice bucket and configured to discharge cubed ice discharged from the ice bucket without crushing, or to crush and discharge the cubed ice.

The ice crushing device may include a housing mounted on an outer surface of the ice bucket, a rotary blade configured to rotate inside the housing, and a fixed blade fixed inside the housing to crush ice together with the rotary blade.

The housing may be mounted on an outer side of a bottom surface of the ice bucket.

The ice bucket may include the bottom surface formed to be inclined with respect to the ground, and a first outlet formed on the bottom surface.

The transfer member may be disposed to rotate about an axis perpendicular to the bottom surface of the ice bucket.

The rotary blade may be disposed to rotate about an axis perpendicular to the bottom surface of the ice bucket.

The housing may include a second outlet formed to discharge ice perpendicular to the ground. The first outlet and the second outlet may be disposed to be biased from each other.

The ice crushing device includes a guide member to guide cubed ice and crushed ice not to be discharged in a state of being mixed. The guide member may be configured to rotate about the same axis as the rotary blade.

The first outlet may be in communication with a first space of the ice crushing device. The second outlet may be disposed between the first space and the fixed blade.

The guide member may be configured to block the second outlet side of the first space such that ice entering the first space through the first outlet does not inadvertently escape to the second outlet.

The guide member may be configured to freely rotate about an axis inclined with respect to the ground. The ice crushing device may further include a guide member support portion formed on the first space side of the second outlet. The guide member may be configured to be supported on the guide member support portion by its own weight to block a gap between the first space and the second outlet.

The guide member may include a blocking portion configured to block ice to prevent the ice entering the first space from escaping to the second outlet, and a slit provided in the blocking portion to allow the rotary blade to pass through the blocking portion.

The ice crushing device may rotate the rotary blade in the first direction to move the cubed ice entering the first space to the second space, and crush the cubed ice together with the fixed blade disposed at an end of the second space, and then discharge the crushed ice to the second outlet.

The ice crushing device may rotate the rotary blade in a second direction opposite to the first direction to push the cubed ice entering the first space, and the cubed ice may push the guide member so that the cubed ice may be discharged to the second outlet.

The ice crushing device may further include a hill portion formed in the first space such that ice entering the first space through the first outlet may be prevented from inadvertently pushing the guide member and escaping to the second outlet.

Another aspect of the present disclosure provides a refrigerator including an ice bucket configured to store ice, an ice crushing blade disposed at an outer side of the ice bucket and configured to crush ice discharged from the ice bucket, and a guide member disposed at the outer side of the ice bucket and configured to guide ice such that cubed ice which is without being crushed and ice which is crushed by the ice crushing blade are prevented from being discharged in a state of being mixed.

The guide member may be configured to freely rotate about an axis inclined with respect to the ground.

Another aspect of the present disclosure provides a refrigerator including an ice bucket configured to store ice, an ice crushing blade configured to crush ice discharged from the ice bucket, and a guide member disposed to rotate about an axis inclined with respect to the ground and configured to guide ice such that cubed ice which is without being crushed and ice which is crushed by the ice crushing blade, are prevented from being discharged in a state of being mixed.

The refrigerator may further include a transfer member disposed inside the ice bucket to transfer ice stored in the ice bucket. The transfer member may be configured to rotate about the same axis as the guide member.

The ice crushing blade may include a rotary blade configured to rotate about the same axis as the guide member.

Advantageous Effects

According to an embodiment of the present disclosure, when cubed ice or crushed ice is discharged, the cubed ice or the crushed ice can be prevented from being discharged in a mixed state of the cubed ice and the crushed ice.

According to an embodiment of the present disclosure, ice can be stored in an ice bucket in a state of not being stuck on an ice crushing blade.

MODE OF THE INVENTION

Figure 1:
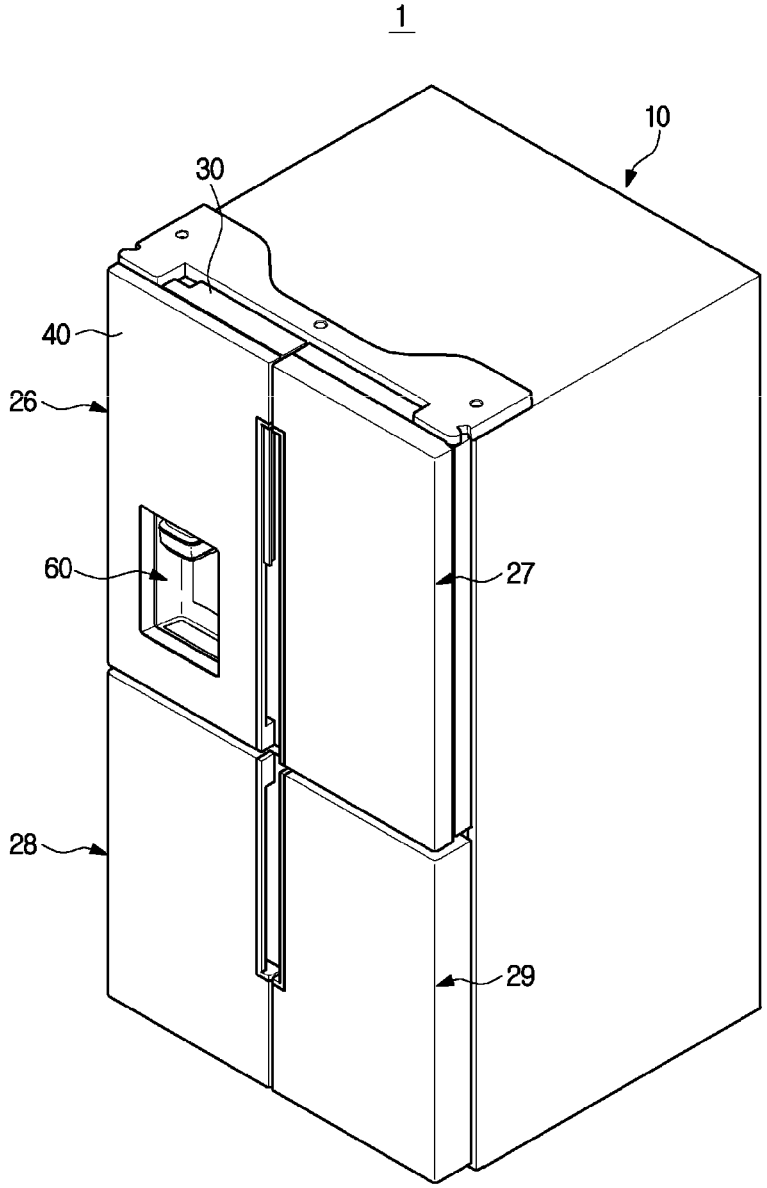
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Hereinafter embodiments of the present disclosure will be described in detail with reference to the accompanying drawings.

Figure 2:
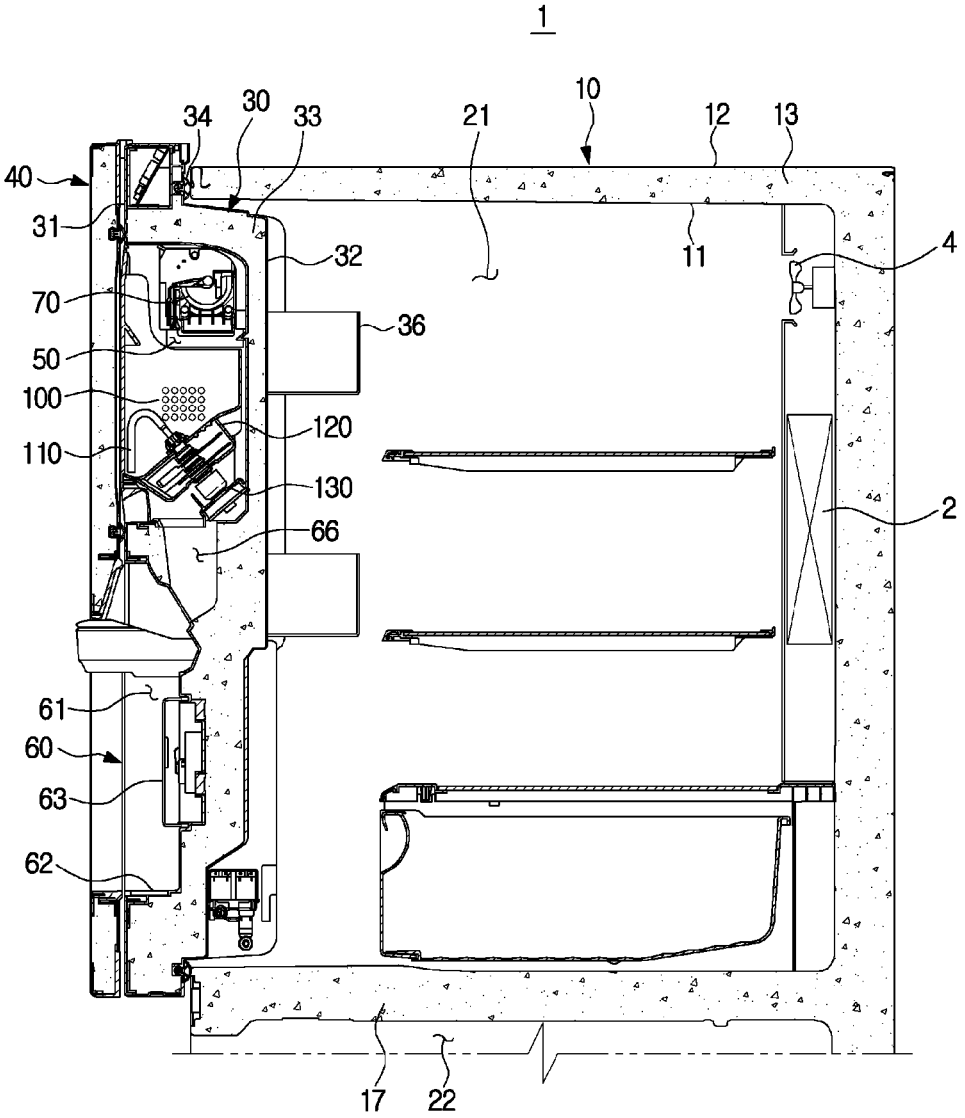
FIG. 2 is a side cross-sectional view schematically illustrating a main configuration of the refrigerator in FIG. 1.
Figure 3:
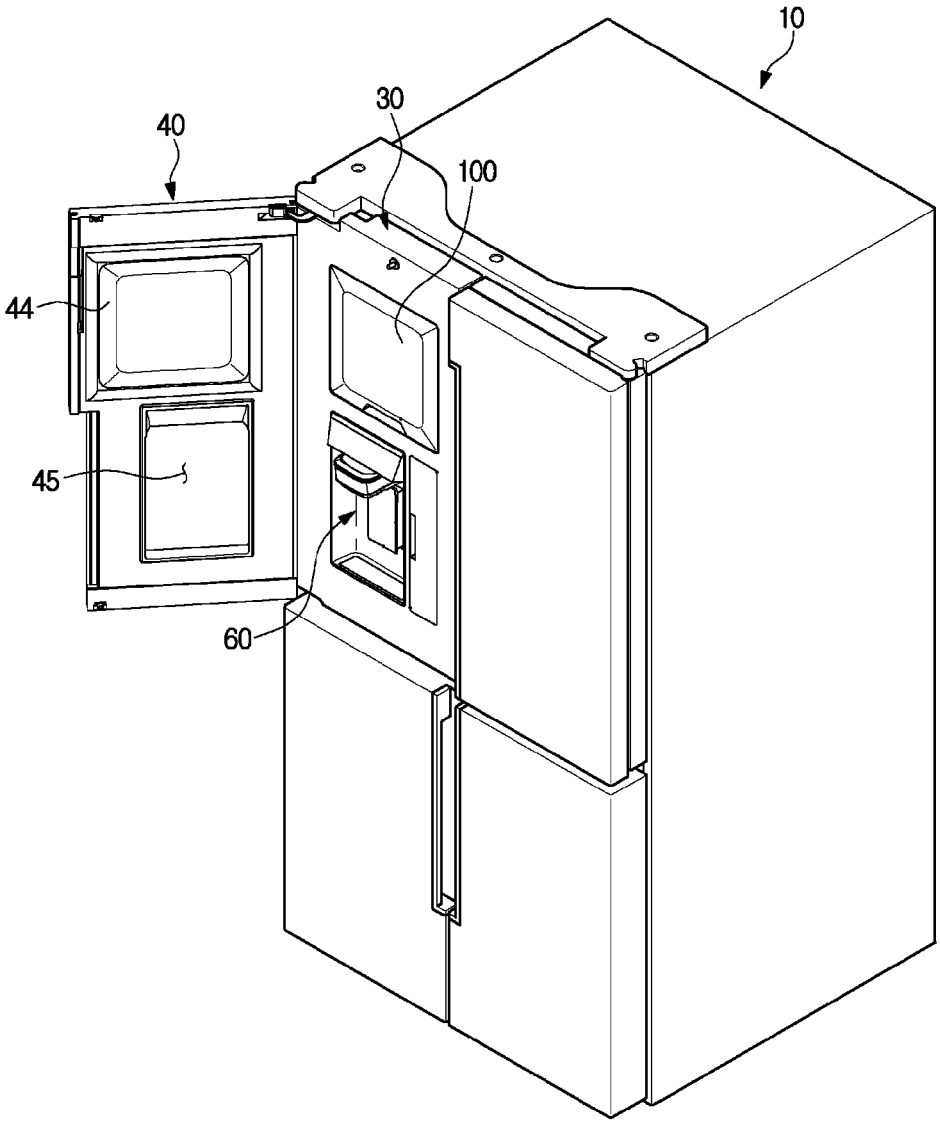
FIG. 3 is a view illustrating a state in which an outer door of the refrigerator in FIG. 1 is opened.
Figure 4:
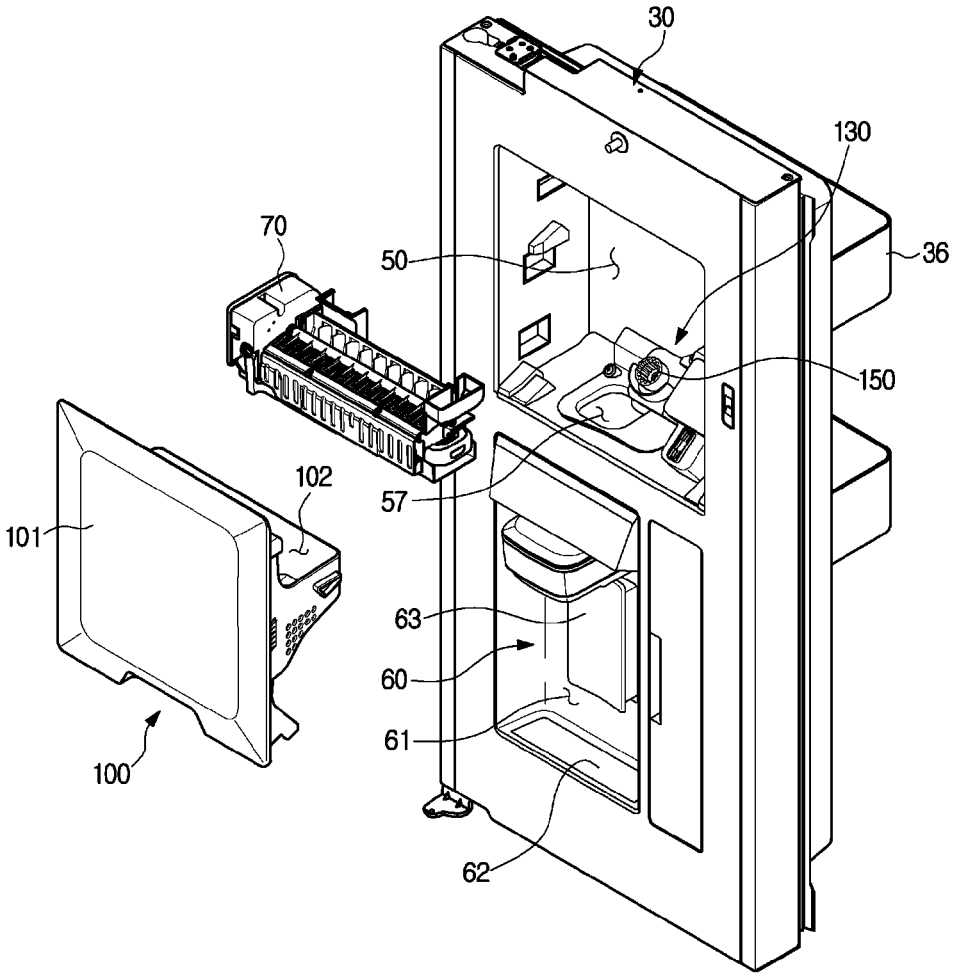
FIG. 4 is an enlarged view of a door of the refrigerator in FIG. 1.
Figure 5:
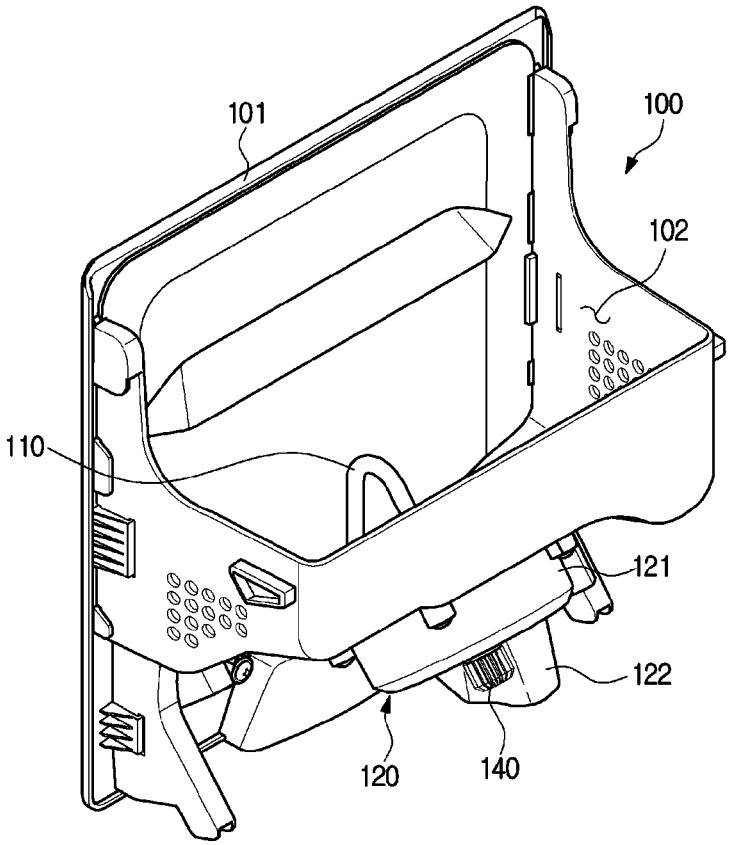
FIG. 5 is a rear perspective view of an ice bucket and an ice crushing device of the refrigerator in FIG. 1.

FIG. 1 is a perspective view of a refrigerator according to an embodiment of the present disclosure, FIG. 2 is a side cross-sectional view schematically illustrating a main configuration of the refrigerator in FIG. 1, FIG. 3 is a view illustrating a state in which an outer door of the refrigerator in FIG. 1 is opened, FIG. 4 is an enlarged view of a door of the refrigerator in FIG. 1, and FIG. 5 is a rear perspective view of an ice bucket and an ice crushing device of the refrigerator in FIG. 1.

Referring to FIGS. 1 to 5, a refrigerator 1 may include a main body 10 having a storage compartment 21, doors 26, 27, 28, and 29 provided in front of the storage compartments 21 and 22, an ice making chamber 50 provided in the door 26 to make and store ice, and a cold air supply device configured to supply cold air to the storage compartment 21.

The cold air supply device may include an evaporator 2, a compressor (not shown), a condenser (not shown), and an expanding device (not shown), and may generate cold air by using evaporative latent heat of a refrigerant. The cold air generated in the evaporator 2 may be supplied to the storage compartments 21 and 22 and the ice making chamber 50 by an operation of a blower fan 4. Although not shown in FIG. 2, an additional evaporator may be disposed in the lower storage compartment 22 to supply cold air to the lower storage compartment 22.

The refrigerator 1 may also include a cold air duct (not shown) connecting an evaporator (not shown) disposed below the cold air duct to the ice making chamber 50 to supply cold air generated in the evaporator (not shown) to the ice making chamber 50.

The main body 10 may include an inner case 11 forming the storage compartments 21 and 22, an outer case 12 coupled to an outer side of the inner case 12 and forming an appearance of the refrigerator 1, and an insulator 13 provided between the inner case 11 and the outer case 12 to insulate the storage compartments 21 and 22. The inner case 11 may be formed by injection molding a plastic material, and the outer case 12 may be formed of a metal material. Urethane foam insulation may be used as the insulator 13, and a vacuum insulation panel may be used together as needed.

The main body 10 may include an intermediate wall 17 and the storage compartments 21 and 22 may be partitioned into the upper storage compartment 21 and the lower storage compartment 22 by the intermediate wall 17. The intermediate wall 17 may include an insulator, and the upper storage compartment 21 and the lower storage compartment 22 may be insulated from each other.

The upper storage compartment 21 may be used as a refrigerating chamber for storing food in a refrigerating mode by maintaining indoor air at a temperature of about 0° C. to 5° C., and the lower storage compartment 22 may be used as a freezing chamber for storing food in a freezing mode by maintaining indoor air at a temperature of about 0° C. to −30° C.

The storage compartments 21 and 22 may have an open front to allow food to be received and withdrawn, and the open front of the storage compartments 21 and 22 may be opened and closed by the doors 26, 27, 28, and 29 rotatably provided in the front of the storage compartments 21 and 22. The storage compartment 21 may be opened and closed by the doors 26 and 27, and the storage compartment 22 may be opened and closed by the doors 28 and 29.

The door 26 may include an inner door 30 rotatably coupled to the main body 10 to open and close the storage compartment 21, and an outer door 40 rotatably provided in the front of the inner door 30. The inner door 30 may be rotatably coupled to the main body 10 by a hinge member. The outer door 40 may be rotatably coupled to the inner door 30 or rotatably coupled to the main body 10, by a hinge member. The inner door 30 and the outer door 40 may be configured to be rotatable in the same direction.

The outer door 40 may have a size corresponding to a size of the inner door 30. Thus, when the inner door 30 and the outer door 40 are both closed, only a dispenser 60 of the inner door 30 may be exposed through an opening 45 of the outer door 40, which will be described later, and the other portions of the inner door 30 may be covered by the outer door 40 and not exposed.

The ice making chamber 50 may be provided in the door 26. Specifically, the ice making chamber 50 may be formed on a front surface of the inner door 30 to be partitioned, separated, and independent from the storage compartment 21 by the inner door 30. The inner door 30 may include a front plate 31, a rear plate 32 coupled to the rear of the front plate 31, and an insulator 33 provided between the front plate 31 and the rear plate 32, and the ice making chamber 50 may be formed by recessing a portion of the front plate 31 toward the insulator 33. The ice making chamber 50 may be formed to have an open front. The open front of the ice making chamber 50 may be opened and closed by the outer door 40.

Urethane foam insulation may be used as the insulator 33, as in the insulator 13 of the main body 10, and a vacuum insulation panel may be used together as needed. The ice making chamber 50 may be insulated from the storage compartment 21 of the main body 10 by the insulator 33.

An ice maker capable of making, storing, and transferring ice may be disposed in the ice making chamber 50. The ice maker may include an ice making tray 70 to make ice by receiving and cooling water, an ice bucket 100 to store the ice produced in the ice making tray 70, an ice crushing device 120 configured to crush ice, and a transfer member 110 to transfer the ice stored in the ice bucket 100 to the ice crushing device 120.

The transfer member 110 may be rotated to agitate or transfer the ice by receiving power from a driving motor unit 130 generating a rotational force. The transfer member 110 and the driving motor unit 130 may be coupled by a first coupler 140 connected to the transfer member 110 and a second coupler 150 connected to the driving motor unit 130, respectively. The first coupler 140 and the second coupler 150 are coupled to each other so that the rotational force generated by the driving motor unit 130 may be transmitted to the transfer member 110.

The ice tray 70 may include an ice making cell capable of containing water, and an ejector configured to move the ice produced in the ice making cell to the ice bucket 100.

The ice maker may include an ice amount sensing device to sense an ice amount in the ice bucket 100 and may be configured to automatically perform a series of operations such as water supply, cooling, ice discharging, ice amount sensing, agitating, and crushing.

The transfer member 110 and the ice crushing device 120 may be integrally provided in the ice bucket 100. An outlet 57 may be formed below the ice bucket 100 and the ice crushing device 120 to discharge ice to a chute 66.

The inner door 30 may include a dispenser 60 configured to provide water and ice to a user. The dispenser 60 may include a dispensing space 61 recessed to receive water and ice, a dispensing tray 62 provided to place a container such as a cup in the dispensing space 61, and a switch 63 capable of inputting an operation command of the dispenser.

The inner door 30 may include the chute 66 connecting the ice making chamber 50 to the dispensing space 61 to guide ice in the ice bucket 100 to the dispensing space 61. The outer door 40 may have the opening 45 to allow access to the dispenser 60 of the inner door 30 in a state where the outer door 40 is closed. The opening 45 may be formed at a position corresponding to the dispenser 60. The opening 45 may be formed in a substantially rectangular shape.

A door guard 36 to store food may be provided at a rear surface of the inner door 30. A gasket 34 in close contact with a front surface of the main body 10 to seal the storage compartment 21 may be provided at the rear surface of the inner door 30, and a gasket 44 in close contact with the front surface of the inner door 30 to seal the ice making chamber 50 may be provided at a rear surface of the outer door 40.

With this configuration, as illustrated in FIGS. 3 and 4, the user may access the ice making chamber 50 and take out the ice bucket 100 by only opening the outer door 40 without having to open the inner door 30. Thus, the user may easily take out ice from the ice bucket 100 and may facilitate the repair, cleaning, and replacement of the ice bucket 100, and the driving motor unit 130, the transfer member 110, and the ice crushing device 120, which are coupled to the ice bucket 100.

In addition, because the inner door 30 may be kept closed when approaching the ice making chamber 50, the outflow of cold air in the storage compartment 21 may be prevented and energy may be saved.

The ice bucket 100 may include an outer surface 101 directing to a front surface of the refrigerator 1 so that the ice making chamber 50 is not exposed to the outside when the outer door 40 is opened. A size of the outer surface 101 may correspond approximately to a size of an opening of the ice making chamber 50 formed in the inner door 30. The ice bucket 100 may store ice in a storage space 102 provided rearward from the outer surface 101.

The ice making tray 70 disposed inside the ice making chamber 50 may be prevented from being exposed to the outside through the outer surface 101. The user may separate the ice bucket 100 after opening the outer door 40 and then separate the ice tray 70.

The driving motor unit 130 coupled to the ice bucket 100 may be disposed at a lower portion of the ice making chamber 50. The drive motor unit 130 may include a motor (not shown) generating a rotational force, and a gear or a plurality of gears (not shown) connected to the motor and may finally transmit the rotational force to the second coupler 150 disposed on the driving motor unit 130 side.

The second coupler 150 may be disposed on the driving motor unit 130 and may be disposed to be inclined toward the front.

The ice crushing device 120 to discharge cubed ice discharged from the ice bucket 100 as it is without crushing, or to crush and discharge the cubed ice may be provided on an outer side of the ice bucket 100. The ice crushing device 120 may include a housing 121 mounted on one surface of the outer side of the ice bucket 100. The housing 121 may include an outlet 122 to discharge cubed ice or crushed ice. The first coupler 140 detachably coupled to the second coupler 150 may be disposed at an outer side of the housing 121 of the ice crushing device 120. The first coupler 140 may be disposed to be inclined toward a rear side of the ice bucket 100 to be coupled to the second coupler 150 when the ice bucket 100 is seated in the ice making chamber 50.

The first coupler 140 and the second coupler 150 may each have a rotating shaft and be disposed in the ice bucket 100 and the driving motor unit 130, respectively, to be rotatable about the rotating shaft. When the first coupler 140 and the second coupler 150 are coupled to each other, the second coupler 150 is rotated by the driving motor unit 130, and the first coupler 140 may be rotated together with the second coupler 150. Accordingly, the first coupler 140 may transmit a rotational force to the transfer member 110 and the ice crushing device 120.

Figure 6:
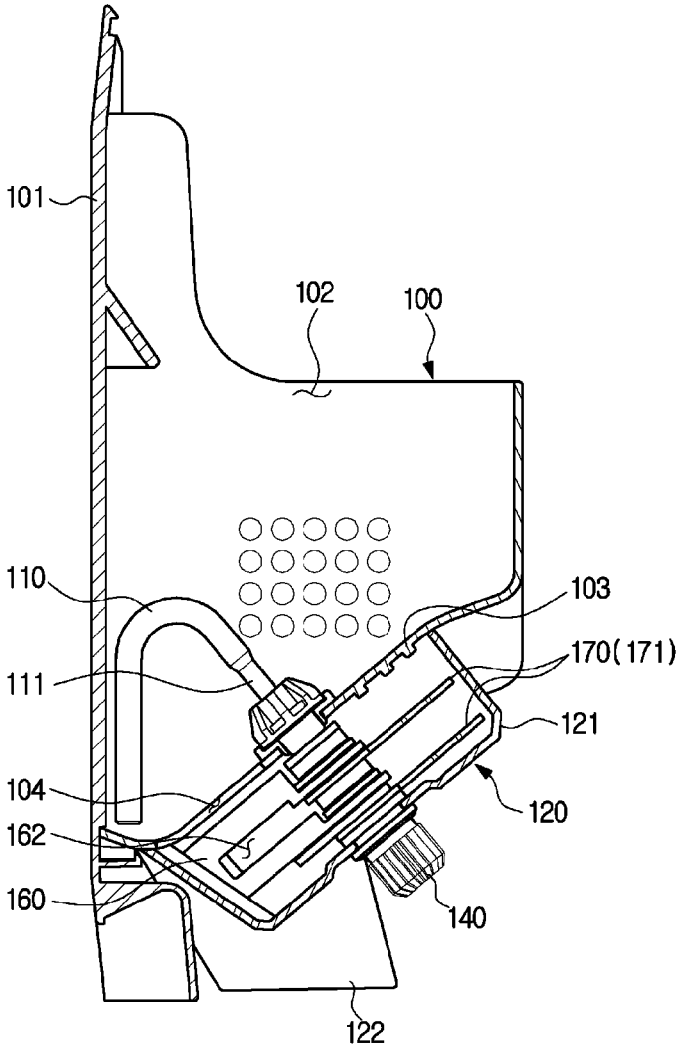
FIG. 6 is a side cross-sectional view of the ice bucket and ice crushing device of the refrigerator in FIG. 1.
Figure 7:
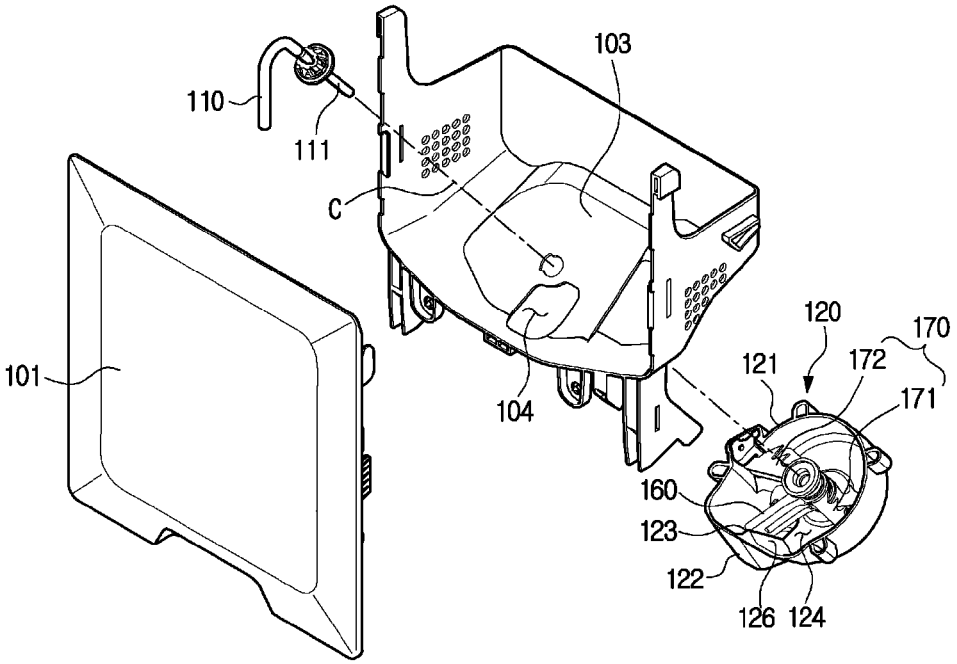
FIG. 7 is an exploded perspective view of the ice bucket and ice crushing device of the refrigerator in FIG. 1.

FIG. 6 is a side cross-sectional view of the ice bucket and ice crushing device of the refrigerator in FIG. 1, and FIG. 7 is an exploded perspective view of the ice bucket and ice crushing device of the refrigerator in FIG. 1.

The ice bucket 100 may include a first outlet 104 formed on a bottom surface 103 of the ice bucket 100 to discharge the ice stored in the storage space 102. The bottom surface 103 of the ice bucket 100 may be formed to be inclined with respect to the ground. The bottom surface 103 of the ice bucket 100 may be formed to be inclined downward toward a front side.

The transfer member 110 may be disposed to rotate about an axis C perpendicular to the bottom surface 103 of the ice bucket 100. The transfer member 110 may be formed to extend from a rotation shaft 111 connected to the first coupler 140. The transfer member 110 and the rotation shaft 111 may be integrally formed.

The transfer member 110 may agitate the ice stored in the storage space 102 of the ice bucket 100 and transfer it to the first outlet 104 side so that the ice may be discharged to the first outlet 104. The transfer member 110 may be formed in a curved shape to agitate and transfer the ice stored in the storage space 102 of the ice bucket 100.

The housing 121 of the ice crushing device 120 may be mounted on an outer side of the bottom surface 103 of the ice bucket 100. The housing 121 may be mounted on the outer side of the bottom surface of the ice bucket 100 to cover the first outlet 104 of the ice bucket 100. The first outlet 104 of the ice bucket 100 may be an inlet of the ice crushing device 120.

The ice crushing device 120 may include an ice crushing blade 170 capable of crushing the ice discharged through the first outlet 104 of the ice bucket 100. Because the ice crushing device 120 is separately mounted on the outer side of the ice bucket 100, the ice crushing blade 170 of the ice crushing device 120 may be kept clean without being stuck to the ice stored in the ice bucket 100.

The ice crushing blade 170 may include a rotary blade 171 disposed to rotate inside the housing 121 and a fixed blade 172 fixed to the inside of the housing 121. The ice crushing blade 170 may crush the ice between the rotary blade 171 and the fixed blade 172 by the rotation of the rotary blade 171.

The rotary blade 171 may be disposed to rotate about the axis C perpendicular to the bottom surface 103 of the ice bucket 100. The rotary blade 171 may be disposed to rotate about the same axis C as the transfer member 110. The rotation shaft 111 connected to the transfer member 110 may be connected to the first coupling 140 by passing through the rotary blade. The rotary blade 171 may rotate in forward and reverse directions by the rotation shaft 111.

Ice stored in the ice bucket 100 may enter the housing 121 of the ice crushing device 120 in a direction parallel to the rotation axis C of the rotary blade 171 through the first outlet 104.

The housing 121 of the ice crushing device 120 may include a second outlet 122 formed to allow the cubed ice introduced from the ice bucket 100 to be discharged without being crushed or to be discharged after being crushed. The second outlet 122 may be formed to allow cubed ice or crushed ice to be discharged perpendicular to the ground.

The first outlet 104 and the second outlet 122 may be arranged not parallel to each other. The first outlet 104 is in communication with the first space 124 inside the housing 121 of the ice crushing device 120, and the second outlet 122 may be formed at one side of the first space 124. As the first outlet 104 and the second outlet 122 are arranged to be biased from each other, ice entering the housing 121 of the ice crushing device 120 through the first outlet 104 may not directly fall into the second outlet 122. The housing 121 of the ice crushing device 120 may include a hill portion 126 formed such that ice entering the first space 124 is not inadvertently moved toward the second outlet 122.

The ice crushing device 120 may include a guide member 160 to guide the cubed ice entering the housing 121 and the ice crushed by the ice crushing blade 170 not to be mixed and then discharged. The guide member 160 may be disposed to freely rotate about the axis C inclined with respect to the ground. The guide member 160 may be disposed inside the housing 121 to rotate about the same axis C as the rotary blade 171.

The ice crushing device 120 may include a guide member support portion 123 provided to support the guide member 160. The guide member support portion 123 may be formed at one side of the first space 124 of the second outlet 122. The guide member support portion 123 may be formed by the hill portion 126 formed in the first space 124. When no external force acts on the guide member 160, the guide member 160 may be supported on the guide member support portion 123 by its own weight.

Figure 8:
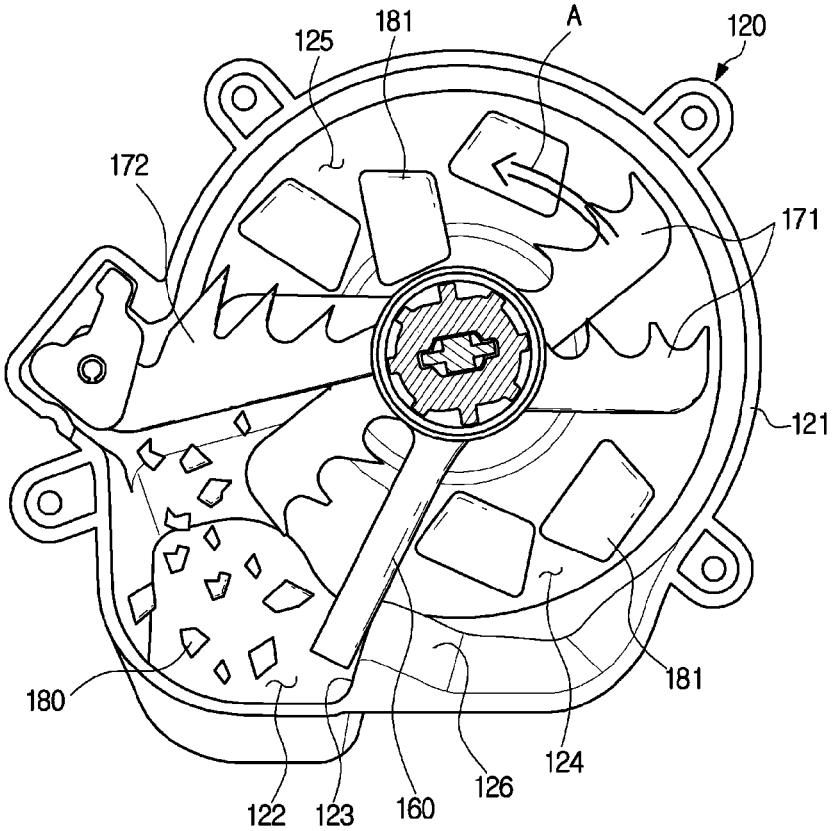
FIG. 8 illustrates that a rotary blade of the ice crushing device in FIG. 1 rotates in a first direction.

FIG. 8 illustrates that a rotary blade of the ice crushing device in FIG. 1 rotates in a first direction.

Referring to FIG. 8, the ice crushing device 120 may crush the ice introduced into the housing 121 through the first outlet 104 provided on the ice bucket 100 by the rotary blade 171 and the fixed blade 172. When the rotary blade 171 rotates in a first direction A, a leading edge of the rotary blade 171 may be roughly formed in a wave shape and a trailing edge thereof may be smoothly formed. An edge of the fixed blade 172 facing the wave-shaped edge of the rotary blade 171 may be roughly formed in a wave shape.

The ice crushing device 120 rotates the rotary blade 171 in the first direction A to move cubed ice 181 entering the first space 124 to the second space 125. The fixed blade 172 may be disposed at one end of the second space 125. The rotary blade 171 may continuously rotate to crush the cubed ice 181 together with the fixed blade 172.

The second outlet 122 of the housing 121 may be disposed between the fixed blade 172 and the first space 124. Crushed ice 180 may be discharged through the second outlet 122 by the rotary blade 171 and the fixed blade 172.

The guide member 160 of the ice crushing device 120 may be disposed to block the second outlet of the first space 124 such that ice entering the first space 124 through the first outlet 104 does not inadvertently escape to the second outlet 122. The guide member 160 may be supported on the guide member support portion 123 to block a gap between the first space 124 and the second outlet 122.

The guide member 160 may be mounted to freely rotate about the axis C inclined with respect to the ground. The guide member 160 disposed to be biased toward the second outlet 122 is to rotate in the first direction A toward the first space 124 by its own weight. The guide member 160 may be supported on the guide member support portion 123 by its own weight.

The ice crushing device 120 may include the hill portion 126 formed in the first space 124 such that ice entering the first space 124 of the housing 121 through the first outlet 104 does not inadvertently push the guide member 160 to escape to the second outlet 122. The hill portion 126 may be formed to be inclined upward toward the second outlet 122 from the first space 124. When the crushed ice 180 is discharged, the cubed ice 181 which is not crushed may be prevented from being mixed and discharged, by the guide member 160 and the hill portion 126.

Figure 9:
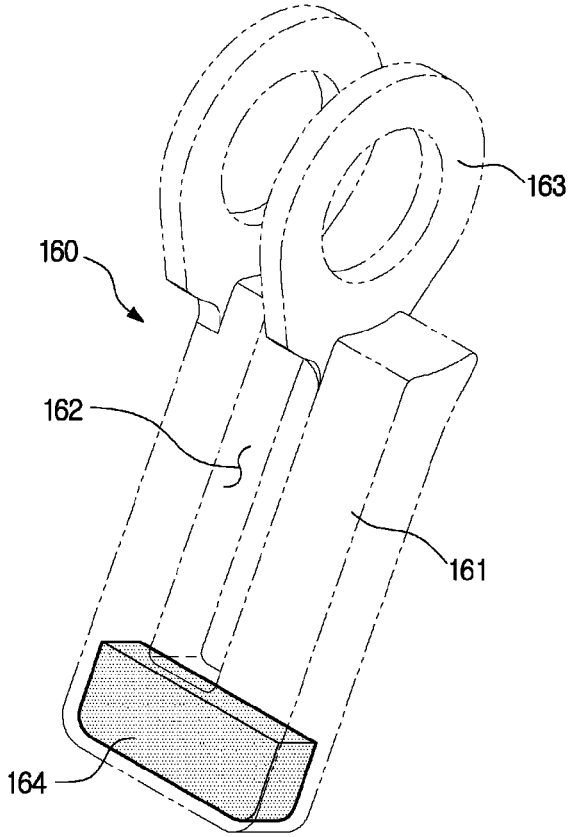
FIG. 9 is a virtual perspective view of a guide member in FIG. 1.

FIG. 9 is a virtual perspective view of a guide member in FIG. 1.

Referring to FIG. 9, the guide member 160 may include a blocking portion 161 to block ice such that the ice entering the first space 124 does not inadvertently escape to the second outlet 122. The guide member 160 may include a slit 162 provided in the blocking portion 161 to allow the rotary blade 171 to pass through the blocking portion 161. The ice crushing device 120 may include a plurality of the rotary blades 171, and at least one of the plurality of rotary blades 171 may be disposed to pass through the slit 162 of the guide member 160.

The guide member 160 may include a shaft coupling portion 163 formed at one end thereof such that the guide member 160 may freely rotate about the same axis C as the rotary blade 171. The guide member 160 may include a heavy weight 164 positioned at the opposite end of the shaft coupling portion 163 to increase the moment of inertia.

Figure 10:
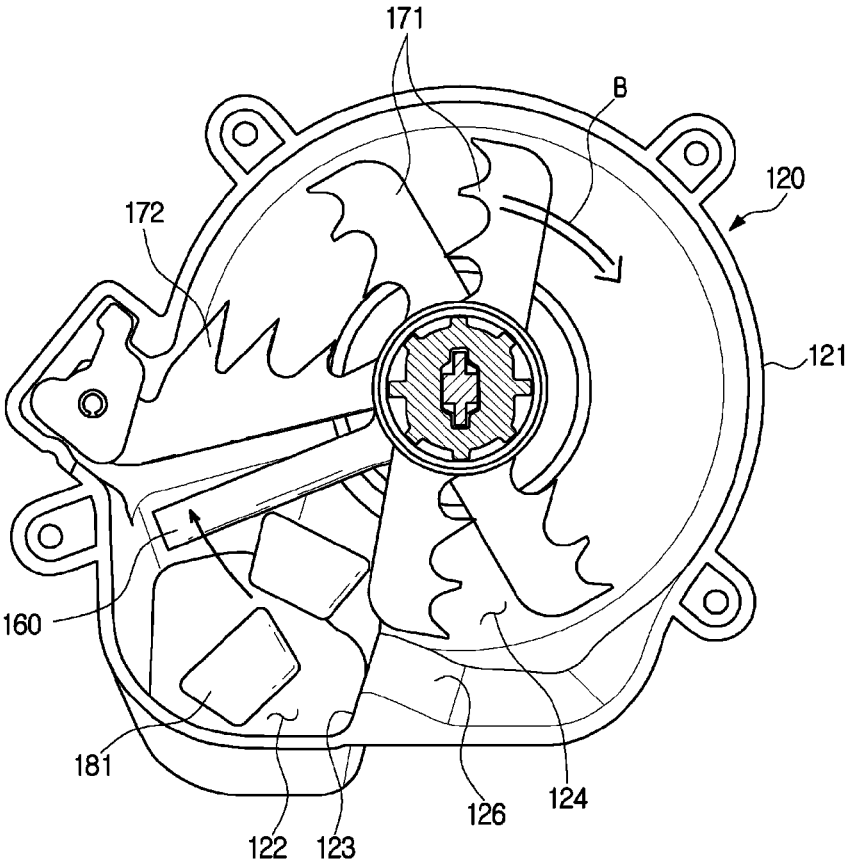
FIG. 10 illustrates that the rotary blade of the ice crushing device in FIG. 1 rotates in a second direction.

FIG. 10 illustrates that the rotary blade of the ice crushing device in FIG. 1 rotates in a second direction.

Referring to FIG. 10, the ice crushing device 120 may not crush ice entering the housing 121 through the first outlet 104 provided in the ice bucket 100 and may discharge the ice in a state of the cubed ice 181. When the rotary blade 171 rotates in a second direction B opposite to the first direction A, the smooth edge of the rotary blade 171 may become a leading edge.

The ice crushing device 120 may rotate the rotary blade 171 in the second direction B to push the cubed ice 181 entering the first space 124 toward the second outlet 122. The rotary blade 171 may push the cubed ice 181 up along the hill portion 126. The cubed ice 181 pushed by the rotary blade 171 may lift the guide member 160 disposed between the first space 124 and the second outlet 122. The cubed ice 181 may be discharged through the second outlet 122 by the continuously rotating rotary blade 171.

The rotary blade 171 may continue to rotate in the second direction B past the guide member 160. The guide member 160 lifted in the second direction B by the cubed ice 181 may descend in the first direction A (see FIG. 8) back to the guide member support portion 123 (see FIG. 8) by its own weight.

The guide member 160 may rotate about the same axis C as the transfer member 110 disposed inside the ice bucket 100 to transfer ice stored in the storage space 102 of the ice bucket 100. The guide member 160, the rotary blade 171, and the transfer member 110 may all rotate about the same axis C.

The rotary blade 171 and the transfer member 110 may rotate in the first direction A and the second direction B by the driving motor unit 130 capable of forward and reverse rotations and the rotation shaft 111. The guide member 160 may rotate freely regardless of a rotation direction of the driving motor unit 130.

Figure 11:
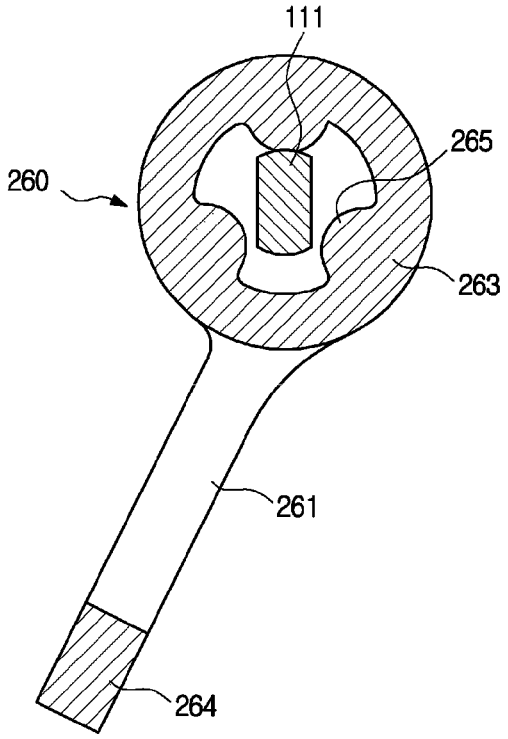
FIG. 11 is a side cross-sectional view of a guide member of a refrigerator according to another embodiment of the present disclosure.

FIG. 11 is a side cross-sectional view of a guide member of a refrigerator according to another embodiment of the present disclosure.

Referring to FIG. 11, a guide member 260 may include a blocking portion 261 blocking ice such that ice entering the first space 124 does not inadvertently escape to the second outlet 122. The guide member 260 may include a slit provided in the blocking portion 261 to allow the rotary blade 171 to pass through the blocking portion 261.

The guide member 260 may include a shaft coupling portion 263 formed at one end thereof such that the guide member 260 may rotate about the same axis C as at least one of the rotary blade 171 and the transfer member 110. The guide member 260 may include a heavy weight 264 positioned at the opposite end of the shaft coupling portion 263 to increase the moment of inertia.

The rotation shaft 111 may be formed such that at least a portion of at least an outer surface of the shaft is flat to facilitate the rotation of the rotary blade 171 or the transfer member 110 in the first direction A or the second direction B.

The rotation shaft 111 may be connected to the first coupling 140 by passing through the shaft coupling portion 263 of the guide member. A protrusion 265 protruding toward the rotation shaft 111 may be disposed on the shaft coupling portion 263 of the guide member 260.

Referring to FIGS. 10 and 11, when the rotation shaft 111 rotates in the second direction B, the guide member 260 may slightly move upward while rotating at a predetermined angle in the second direction B by the contact between the protrusion 265 and the rotation shaft 111. When the rotation shaft 111 continuously rotates in the first direction B to pass through the peak of the protrusion 265 so that the contact with the protrusion 265 is released, the guide member 260 may return by rotating in the first direction A by its own weight.

When the rotation shaft 111 rotates in the second direction B so that the ice crushing device 120 discharges the cubed ice 181, the guide member 260 allows the cubed ice 181, which enters the first space 124 of the housing 121 by the rotation shaft 111 and the protrusion 265, to be easily discharged toward the second outlet 122.

Referring to FIGS. 8 and 11, when the rotation shaft 111 rotates in the first direction A, the guide member 260 may receive a force toward the guide member support portion 123 by the contact between the protrusion 265 and the rotation shaft 111. Because the guide member is supported on the guide member support portion 123, even if the rotation shaft 111 comes into contact with the protrusion 265, the guide member may move upwards slightly without rotating in the first direction A. When the rotation shaft 111 continuously rotates in the first direction A to pass through the peak of the protrusion 265 so that the contact with the protrusion 265 is released, the guide member 260 may move downwards slightly by its own weight.

When the rotation shaft 111 rotates in the first direction A so that the ice crushing device 120 discharges the crushed ice 180, the guide member 260 receives a force toward the guide member support portion 123 by the rotation shaft 111 and the protrusion 265. Therefore, the guide member 260 may more firmly block the gap between the first space 124 and the second outlet 122 to prevent the cubed ice 181 from falling into the second outlet 122 in the first space 124 of the housing 121.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body having a horizontal upper surface;

an ice bucket configured to store ice;

a transfer member configured to rotate about an axis which is oblique with respect to the horizontal upper surface of the main body, and to transfer ice stored in the ice bucket; and an ice crushing device disposed at an outer side of the ice bucket and configured to discharge cubed ice discharged from the ice bucket without crushing, or to crush and discharge the cubed ice, wherein the ice crushing device includes:

a housing mounted on an outer surface of the ice bucket, a rotary blade to rotate inside the housing, a fixed blade fixed inside the housing to crush ice together with the rotary blade, and a guide member to rotate about a same axis as the rotary blade and to guide cubed ice and crushed ice so as not to be discharged in a state of being mixed, wherein a first outlet is in communication with a first space of the ice crushing device, a second outlet is disposed between the first space and the fixed blade with respect to a rotational direction of the rotary blade, the guide member is configured to block the second outlet side of the first space such that ice entering the first space through the first outlet does not inadvertently escape to the second outlet, the guide member is configured to freely rotate about the axis which is oblique with respect to the horizontal upper surface of the main body, and the guide member includes a blocking portion to block ice to prevent the ice entering the first space from escaping to the second outlet, and a slit disposed in the blocking portion to allow the rotary blade to pass through the blocking portion.

2. The refrigerator according to claim 1, wherein the housing is mounted on an outer side of a bottom surface of the ice bucket.

3. The refrigerator according to claim 2, wherein the ice bucket includes:

the bottom surface formed to be oblique with respect to the horizontal upper surface of the main body, and the first outlet is formed on the bottom surface.

4. The refrigerator according to claim 3, wherein the axis which is oblique with respect to the horizontal upper surface of the main body is perpendicular to the oblique bottom surface of the ice bucket.

5. The refrigerator according to claim 3, wherein the rotary blade is disposed to rotate about an axis perpendicular to the oblique bottom surface of the ice bucket.

6. The refrigerator according to claim 3, wherein the housing includes the second outlet and the second outlet is formed to discharge ice in a downward vertical direction which is perpendicular to a horizontal direction that is parallel with the horizontal upper surface of the main body, and the first outlet and the second outlet are disposed to be biased from each other.

7. The refrigerator according to claim 1, wherein the ice crushing device further includes a guide member support portion formed on the first space side of the second outlet, and the guide member is configured to be supported on the guide member support portion by its own weight to block a gap between the first space and the second outlet.

8. The refrigerator according to claim 7, wherein the ice crushing device is to rotate the rotary blade in a first direction to move the cubed ice entering the first space to a second space, and is to crush the cubed ice together with the fixed blade disposed at an end of the second space, and then to discharge the crushed ice to the second outlet.

9. The refrigerator according to claim 7, wherein the ice crushing device is to rotate the rotary blade in a second direction opposite to a first direction to push the cubed ice entering the first space, such that the cubed ice pushes the guide member and the cubed ice is discharged to the second outlet.

10. The refrigerator according to claim 7, wherein the ice crushing device further includes a hill portion formed in the first space such that ice entering the first space through the first outlet is prevented from inadvertently pushing the guide member and escaping to the second outlet.

11. The refrigerator according to claim 1, wherein the transfer member includes a first portion which extends along the axis which is oblique with respect to the horizontal upper surface of the main body, and a second portion which extends from the first portion and is curved downward toward a bottom portion of the ice bucket.

12. The refrigerator according to claim 1, wherein the transfer member is to rotate without rotating the housing.

13. The refrigerator according to claim 1, wherein the ice crushing device includes a coupler, disposed on an outer side of housing, to receive a rotational force transmitted by a driving motor, and the transfer member includes a rotation shaft which passes through a coupling hole disposed in a bottom surface of the ice bucket, to be connected to the coupler to receive a rotational driving force transmitted by the coupler.

14. A refrigerator comprising:

a main body having a horizontal upper surface;

an ice bucket to store ice;

a transfer member to transfer ice stored in the ice bucket; and an ice crushing device, disposed at an outer side of the ice bucket, to discharge cubed ice discharged from the ice bucket without crushing, or to crush and discharge the cubed ice, wherein the ice crushing device includes:

a housing mounted on an outer surface of the ice bucket, a rotary blade to rotate inside the housing, a fixed blade fixed inside the housing to crush ice together with the rotary blade, a guide member to rotate about a same axis as the rotary blade and to guide cubed ice and crushed ice so as not to be discharged in a state of being mixed, and a guide member support portion, wherein a first outlet is in communication with a first space of the ice crushing device, a second outlet is disposed between the first space and the fixed blade with respect to a rotational direction of the rotary blade, the guide member is to block the second outlet side of the first space such that ice entering the first space through the first outlet does not inadvertently escape to the second outlet, the guide member is to freely rotate about an axis oblique with respect to the horizontal upper surface of the main body, the guide member support portion is formed on the first space side of the second outlet, the guide member is to be supported on the guide member support portion by its own weight to block a gap between the first space and the second outlet, and the guide member includes a blocking portion to block ice to prevent the ice entering the first space from escaping to the second outlet, and a slit disposed in the blocking portion to allow the rotary blade to pass through the blocking portion.

* * * * *